US010505347B2

(12) United States Patent
Shibata et al.

(10) Patent No.: US 10,505,347 B2
(45) Date of Patent: Dec. 10, 2019

(54) SPARK PLUG FOR INTERNAL COMBUSTION ENGINE

(71) Applicant: DENSO CORPORATION, Kariya, Aichi-pref. (JP)

(72) Inventors: Masamichi Shibata, Kariya (JP); Ryohei Akiyoshi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/089,479

(22) PCT Filed: Mar. 17, 2017

(86) PCT No.: PCT/JP2017/011021

§ 371 (c)(1),
(2) Date: Sep. 28, 2018

(87) PCT Pub. No.: WO2017/169930

PCT Pub. Date: Oct. 5, 2017

(65) Prior Publication Data

US 2019/0199068 A1 Jun. 27, 2019

(30) Foreign Application Priority Data

Mar. 30, 2016 (JP) ..... 2016-069291

(51) Int. Cl.

| | |
|---|---|
| ***H01T 13/32*** | (2006.01) |
| ***H01T 13/39*** | (2006.01) |
| ***H01T 21/02*** | (2006.01) |

(52) U.S. Cl.

CPC ..... *H01T 13/32* (2013.01); *H01T 21/02* (2013.01); *H01T 13/39* (2013.01)

(58) Field of Classification Search

CPC ..... H01T 13/32; H01T 13/39; H01T 21/00; H01T 21/02

See application file for complete search history.

(56) References Cited

U.S. PATENT DOCUMENTS 6,470,845 B2 * 10/2002 Kanao ..... H01T 13/39 123/169 EL
8,884,503 B2 * 11/2014 Nagasawa ..... H01T 13/16 313/141

(Continued)

FOREIGN PATENT DOCUMENTS

JP 9-148045 6/1997
JP 2003-229231 8/2003

(Continued)

*Primary Examiner* — Mariceli Santiago

(74) *Attorney, Agent, or Firm* — Nixon & Vanderhye, P.C.

(57) ABSTRACT

There is provided a spark plug for an internal combustion engine with a simple configuration capable of ensuring stable ignitability regardless of mounting posture to the internal combustion engine. The spark plug includes a housing, an insulator, a center electrode, and a ground electrode. The ground electrode includes an erecting part that is erected from a tip part of the housing to a tip side and an inclined part that is bent from the tip of the erecting part to the center electrode side to extend obliquely toward a tip side. An end edge of the ground electrode on an opposite side to the housing side is a tip of the inclined part. The erecting part satisfies $w/t \leq 1$, $w \leq 1.9$ mm, and $t \leq 2.3$ mm, where t is a dimension in an alignment direction of the erecting part and the center electrode, and w is a dimension in a width direction orthogonal to each of the alignment direction and a plug axial direction. An inclination angle θ of the inclined part with respect to the plug axial direction satisfies $30° \leq \theta \leq 60°$.

8 Claims, 5 Drawing Sheets

(56) References Cited

U.S. PATENT DOCUMENTS

| | | | | |
|---|---|---|---|---|
| 2001/0004183 | A1* | 6/2001 | Moriya | H01T 13/32<br>313/141 |
| 2002/0067111 | A1 | 6/2002 | Shibata et al. | |
| 2005/0179353 | A1* | 8/2005 | Watanabe | H01T 13/20<br>313/141 |
| 2018/0069378 | A1* | 3/2018 | Shibata | H01T 13/08 |

FOREIGN PATENT DOCUMENTS

| | | |
|---|---|---|
| JP | 2010-238377 | 10/2010 |
| JP | 2012-256590 | 12/2012 |

* cited by examiner

SPARK PLUG FOR INTERNAL COMBUSTION ENGINE

CROSS-REFERENCE TO RELATED APPLICATION

This application is the national phase of International Application No. PC/JP2017/011021 flied on Mar. 17, 2017 which designated the U.S. and claims priority to Japanese Patent Application No. 2016-069291 filed on Mar. 30, 2016, the entire contents of each of which are incorporated herein by reference.

TECHNICAL FIELD

The present disclosure relates to a spark plug for an internal combustion engine used in an automotive engine or the like.

BACKGROUND ART

As a spark plug used as an ignition means in an internal combustion engine, such as an automotive engine, there is one in which a center electrode and a ground electrode are made to axially face each other to form a spark discharge gap. Such a spark plug causes discharge at the spark discharge gap and ignites air-fuel mixture in a combustion chamber by the discharge.

Here, in the combustion chamber, airflow of the air-fuel mixture, for example, such as swirl flow or tumble flow, is formed and the airflow moderately flows also at the spark discharge gap to thereby ensure ignitability.

However, depending on a mounting posture of the spark plug to the internal combustion engine, a part of the ground electrode joined to a tip part of a housing may be arranged on an upstream side of the spark discharge gap in the airflow. In this case, the airflow in the combustion chamber is blocked by the ground electrode, and the airflow near the spark discharge gap may stagnate. As a result, ignitability of the spark plug may degrade. That is, there may occur a problem that ignitability of the spark plug varies depending on the mounting posture to the internal combustion engine. Particularly, in recent years, although internal combustion engines using lean burn are used frequently, in such an internal combustion engine, combustion stability may degrade depending on the mounting posture of the spark plug.

In addition, it is difficult to control the mounting posture of the spark plug to the internal combustion engine, that is, the position of the ground electrode in a circumferential direction unless special measures are taken. This is because the mounting posture varies due to the formation state of a mounting screw in the housing or the tightening degree of the spark plug at the time of mounting work to the internal combustion engine. Note that, it may be considered to take such a special measure as to limit the relation between the mounting screw and the joining position of the ground electrode in the circumferential direction of the spark plug to a specific positional relation and also to limit a female screw on an engine head side to a predetermined direction in the circumferential direction. However, in this case, there is a problem that this leads to increase in manufacturing effort and manufacturing cost of the spark plug and the engine head.

Therefore, to suppress airflow from being blocked by the ground electrode, a configuration in which drilling is performed on the ground electrode and a configuration in which the ground electrode is joined to the housing by a plurality of thin plate members are disclosed (Patent Literature 1).

CITATION LIST

Patent Literature

[PTL 1] JP H9-148045 A

SUMMARY OF THE INVENTION

The configuration in which drilling processing is performed on the ground electrode, which is described in Patent Literature 1, may cause reduction in strength of the ground electrode. Further, if the ground electrode is formed thick to prevent the reduction in strength, eventually the airflow of the air-fuel mixture is easily blocked.

In addition, the configuration in which the ground electrode is joined to the housing by a plurality of thin plate members, which is also described in Patent Literature 1, has problems of making the shape of the ground electrode complicated, increasing the manufacturing man-hours, and increasing the manufacturing cost.

The present disclosure provides a spark plug for an internal combustion engine with a simple configuration, which can ensure stable ignitability regardless of the mounting posture to the internal combustion engine.

One aspect of the present disclosure is a spark plug including:

a cylindrical housing;

a cylindrical insulator held inside the housing;

a center electrode held inside the insulator such that a tip part of the center electrode projects; and a ground electrode that is connected to the housing and forms a spark discharge gap between the center electrode and the ground electrode, wherein the ground electrode includes an erecting part that is erected from a tip part of the housing to a tip side and an inclined part that is bent from the tip of the erecting part to the center electrode side to extend obliquely toward a tip side, an end edge of the ground electrode on an opposite side to the housing side is a tip of the inclined part, the erecting part satisfies $w/t \leq 1$, $w \leq 1.9$ mm, and $t \leq 2.3$ mm, where t is a dimension in an alignment direction of the erecting part and the center electrode, and w is a dimension in a width direction orthogonal to each of the alignment direction and a plug axial direction, and an inclination angle $\theta$ of the inclined part with respect to the plug axial direction satisfies $30° \leq \theta \leq 60°$.

In the spark plug for the internal combustion engine mentioned above, each dimension of the erecting part of the ground electrode satisfies $w/t \leq 1$, $w \leq 1.9$ mm, and $t \leq 2.3$ mm, and the inclination angle $\theta$ of the inclined part satisfies $30° \leq \theta \leq 60°$. This suppresses phenomenon that the airflow in the combustion chamber toward the spark discharge gap is blocked by the mounting posture of the spark plug to the internal combustion engine. That is, even if the erecting part of the ground electrode is arranged at a position on an upstream side of the airflow with respect to the spark discharge gap, the airflow at the spark discharge gap can be ensured.

Consequently, regardless of the mounting posture of the spark plug to the internal combustion engine, the discharge spark can be sufficiently stretched, and ignitability can be sufficiently ensured.

In addition, in the spark plug, the ground electrode does not need to have a particularly complicated shape. Further, since the ground electrode does not need to be made particularly thin, it also does not need to have a special structure for ensuring its strength. Therefore, a spark plug excellent in ignitability with a simple structure can be obtained.

As described above, the present disclosure can provide a spark plug for an internal combustion engine with a simple configuration capable of ensuring stable ignitability regardless of the mounting posture to the internal combustion engine.

BRIEF DESCRIPTION OF THE DRAWINGS

The above object, the other objects, and characteristics and advantages of the present disclosure become clearer by detailed description described below with reference to the accompanying drawings. In the accompanying drawings.

DESCRIPTION OF THE EMBODIMENTS

Embodiment 1

An embodiment of a spark plug for an internal combustion engine will be described with reference to FIGS. 1 to 7.

Figure 1:
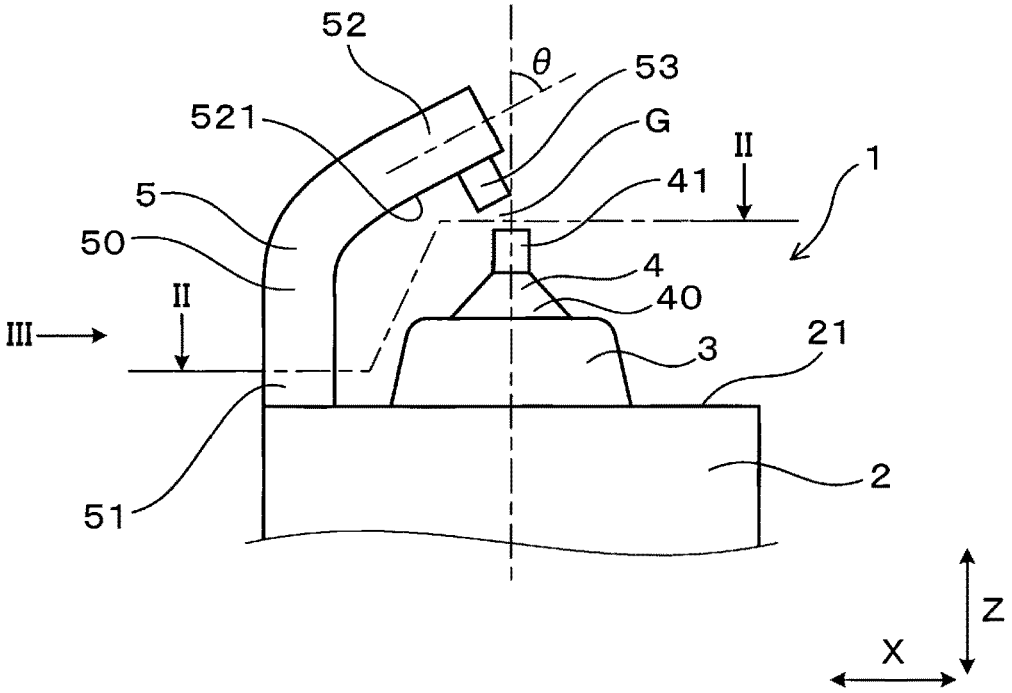
FIG. 1 is a front explanatory view of a tip part of a spark plug in Embodiment 1.
Figure 2:
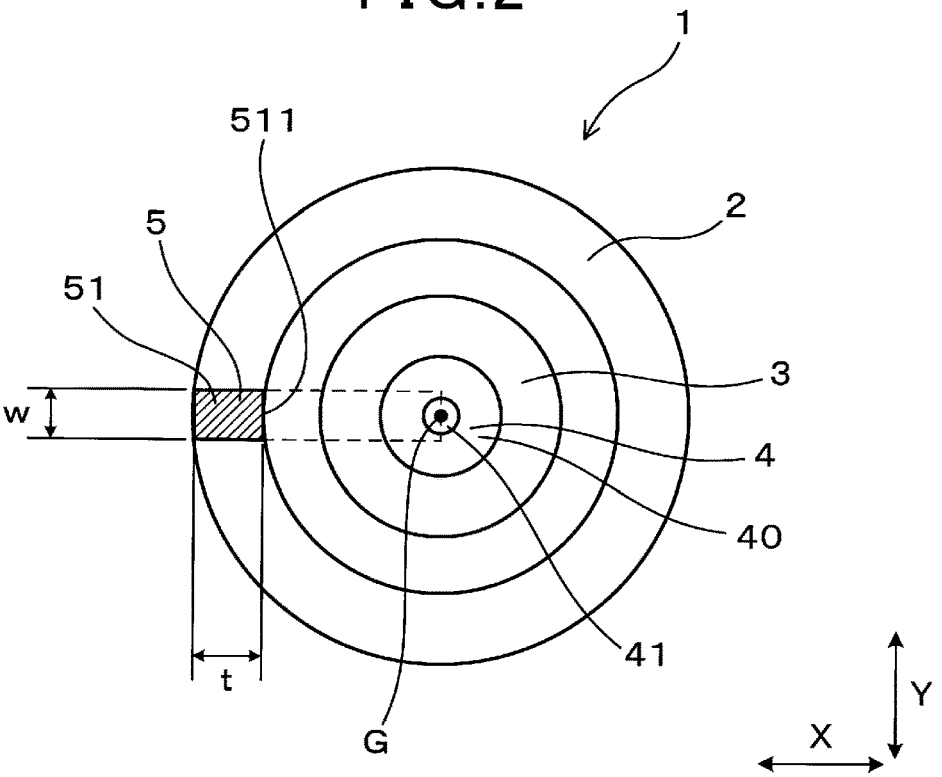
FIG. 2 is a sectional view along a line II-II of FIG. 1.
Figure 3:
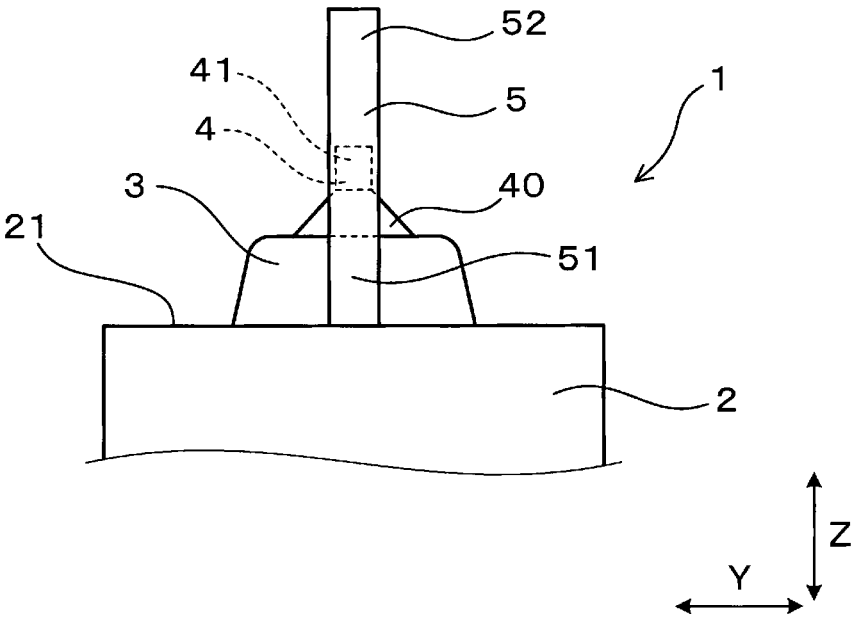
FIG. 3 is a view on arrow III of FIG. 1.

As shown in FIGS. 1 to 3, a spark plug 1 of the present embodiment includes a cylindrical housing 2, a cylindrical insulator 3, a center electrode 4, and a ground electrode 5.

The insulator 3 is held inside the housing 2. The center electrode 4 is held inside the insulator 3 so that a tip part 41 thereof projects. The ground electrode 5 is connected to the housing 2 and forms a spark discharge gap G between the ground electrode 5 and the center electrode 4.

As shown in FIG. 1, the ground electrode 5 includes an erecting part 51 and an inclined part 52. The erecting part 51 is a portion erected from a tip part 21 of the housing 2 to a tip side. The inclined part 52 is a portion that is bent from a tip of the erecting part 51 to the center electrode 4 side to extend obliquely toward a tip side.

The erecting part 51 has a shape of the following dimensional relation. First, as shown in FIG. 2, t is a dimension of the erecting part 51 in an alignment direction X of the erecting part 51 and the center electrode 4. Similarly, w is a dimension of the erecting part 51 in a width direction Y orthogonal to each of the alignment direction X and a plug axial direction Z. At this time, w and t satisfy $w/t\leq1$, $w\leq1.9$ mm, and $t\leq2.3$ mm. In the following, for convenience sake, the dimensions w and t are also referred to as a width w and a thickness t, respectively.

Further, as shown in FIG. 1, an inclination angle θ of the inclined part 52 with respect to the plug axial direction Z satisfies $30°\leq\theta\leq60°$.

Note that the plug axial direction Z is a direction of a central axis of the spark plug 1. The tip side is a side on which the spark plug 1 is inserted into a combustion chamber in the plug axial direction Z, and its opposite side is a base end side. The alignment direction X, the width direction Y, and the plug axial direction Z are orthogonal to each other.

As shown in FIG. 2, the erecting part 51 of the ground electrode 5 has a rectangular cross section orthogonal to the plug axial direction Z. The rectangular shape herein is a concept also including a square shape.

An inward face 511 corresponding to one side of the rectangular shape in the cross section of the erecting part 51 is arranged to face the center electrode 4 side. In the present embodiment, the inward face 511 corresponds to a short side of the rectangular shape in the cross section of the erecting part 51. The length of the short side is the width w of the erecting part 51. The length of a long side of the rectangular shape in the cross section of the erecting part 51 is the thickness t of the erecting part 51.

As described above, the thickness t of the shape of the cross section orthogonal to the plug axial direction Z of the erecting part 51 is equal to or more than the width w. Preferably, the dimension t is larger than the dimension w. More preferably, $w/t\leq0.9$ is made to hold. In addition, preferably, the sectional area of the erecting part 51 in the cross section orthogonal to the plug axial direction Z is 1.5 $mm^2$ or more. Thereby, heat resistance of the ground electrode 5 can be easily ensured.

The ground electrode 5 is formed into a shape including the erecting part 51 and the inclined part 52 by bending a rod-shaped metallic member having a rectangular cross section orthogonal to the longitudinal direction. Thus, also as to the inclined part 52, the shape of the cross section of the inclined part 52 orthogonal to the longitudinal direction is the same rectangular shape as the cross-sectional shape of the erecting part 51. The inclination angle θ of the inclined part 52 with respect to the plug axial direction Z is 30° to 60°. In the present embodiment, the inclination angle θ is comparable to the inclination angle of the inclined part 52 with respect to the erecting part 51.

The ground electrode 5 has a projection part 53 projecting from a facing face 521 that faces the center electrode 4 side in the inclined part 52. The spark discharge gap G is formed between the projection part 53 and the tip part 41 of the center electrode 4.

The projection part 53 is formed by joining, for example, a precious metal chip made of a platinum alloy to the facing face 521. That is, the ground electrode 5 has a ground electrode base material 50 made of a nickel alloy and the projection part 53 made of the precious metal chip. The precious metal chip is welded to the ground electrode base material 50.

In addition, the center electrode 4 is also formed by joining, for example, a precious metal chip made of an iridium alloy to the tip of a center electrode base material 40. That is, the precious metal chip constitutes the tip part 41 of the center electrode 4.

The spark plug 1 of the present embodiment is used in an internal combustion engine for a vehicle, such as an automobile, for example.

Next, functions and effects of the present embodiment will be described.

In the spark plug 1 for the internal combustion engine, the dimensions of the erecting part 51 of the ground electrode 5 satisfy w/t≤1, w≤1.9 mm, and t≤2.3 mm, and the inclination angle θ of the inclined part 52 satisfies 30°≤θ≤60°. This makes it possible to suppress the phenomenon that the airflow in the combustion chamber toward the spark discharge gap G is blocked from occurring by the mounting posture of the spark plug 1 to the internal combustion engine. That is, even if the erecting part 51 of the ground electrode 5 is arranged at a position on an upstream side of the airflow with respect to the spark discharge gap G, the airflow in the spark discharge gap G can be ensured.

Figure 4:
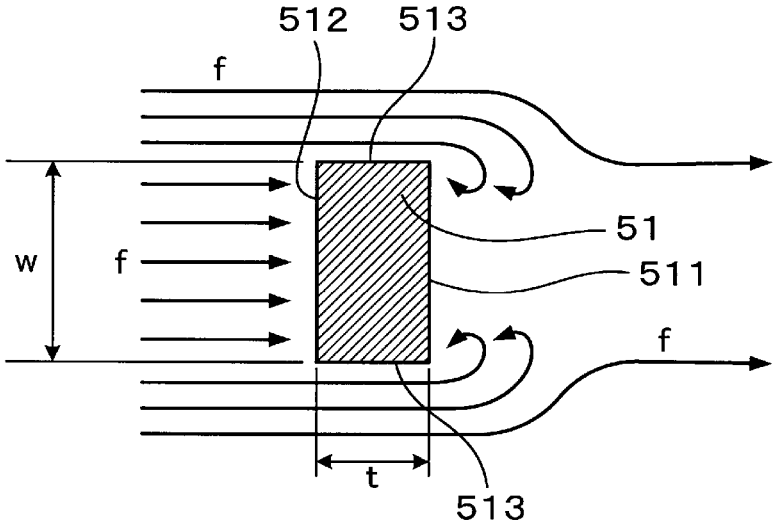
FIG. 4 is an explanatory view of flow of an airflow when a cross-sectional shape of an erecting part satisfies $w/t>1$.

First, since w/t≤1 holds, it is possible to prevent an airflow f toward the spark discharge gap G arranged on the downstream side of the erecting part 51 from being blocked by the erecting part 51. That is, if w/t>1 holds in the erecting part 51, as shown in FIG. 4, not only the airflow f hits against a back face 512 of the erecting part 51 and is blocked, but also the airflow f passing along a side face 513 of the erecting part 51 generates large vortexes near the both ends of the inward face 511. Thereby, the airflow f passing a side of the erecting part 51 is largely separated from the side face 513 of the erecting part 51. As a result, the airflow f flows slow near the spark discharge gap G arranged on the downstream side of the erecting part 51.

Figure 5:
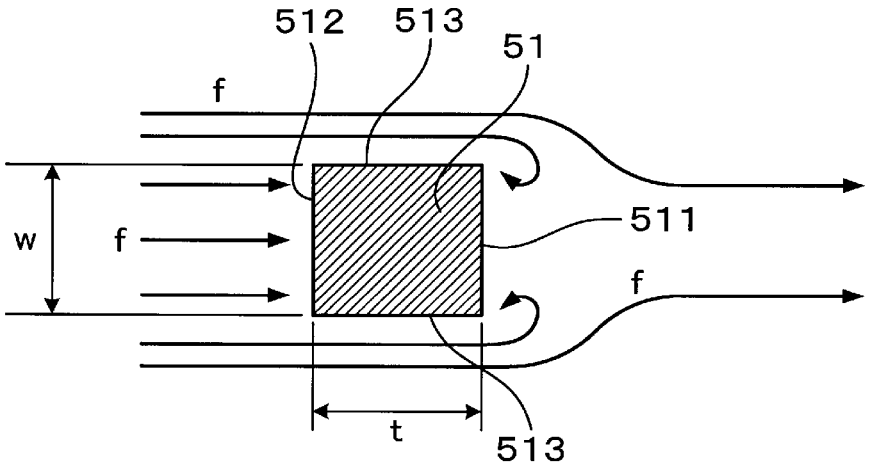
FIG. 5 is an explanatory view of flow of the airflow when the cross-sectional shape of the erecting part satisfies $w/t\leq1$.

On the other hand, as shown in FIG. 5, since w/t≤1 is made to hold in the shape of the erecting part 51, the vortexes near the both ends of the inward face 511 can be made small. This makes it possible to suppress the airflow f from the side face 513 of the erecting part 51 from separating. Consequently, the flow speed of the airflow f near the spark discharge gap G arranged on the downstream side of the erecting part 51 can be maintained.

Figure 6:
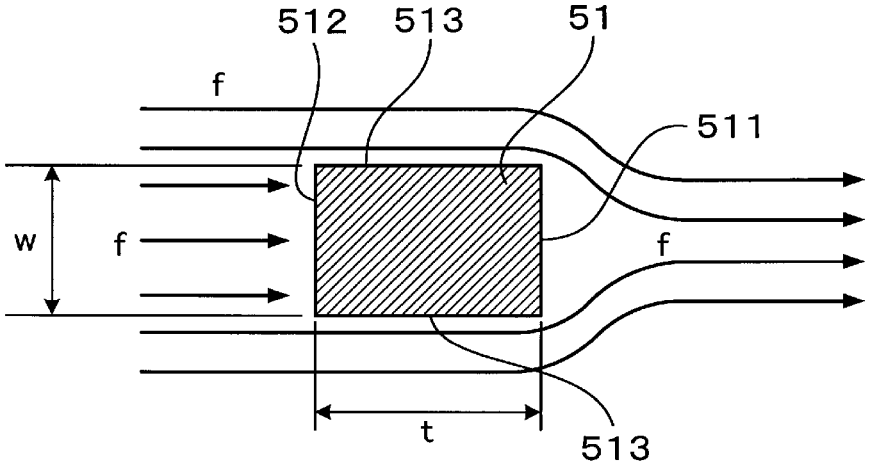
FIG. 6 is an explanatory view of flow of the airflow when w/t is even smaller in the cross-sectional shape of the erecting part.

Further, as shown in FIG. 6, by making the value of w/t further smaller in the shape of the erecting part 51, the airflow f from the side face 513 of the erecting part 51 can be further suppressed from separating by further suppressing the vortexes of the airflow from occurring. Consequently, the flow speed of the airflow f near the spark discharge gap G arranged on the downstream side of the erecting part 51 can be increased.

As described above, it is possible to suppress the airflow f from being blocked by the erecting part 51, not only by simply making the dimension w of the erecting part 51 small, but also by making the value of w/t small. The appropriate value of w/t is w/t≤1, and the more appropriate value is w/t≤0.9. These values are backed up by Experiment Example 1 described below.

Figure 7:
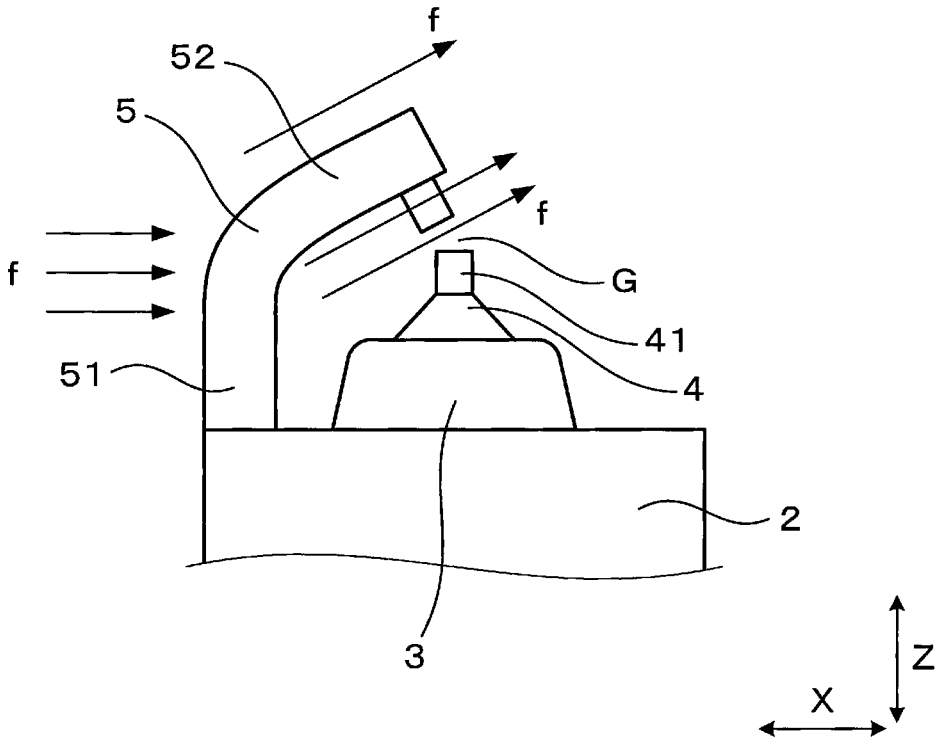
FIG. 7 is an explanatory view of the airflow along an inclined part in Embodiment 1.

In addition, the ground electrode 5 is formed so that the inclined part 52 extends to the oblique tip side. Thereby, as described above, the airflow f having passed along the side face 513 of the erecting part 51 can be guided to the tip side of the spark plug 1, as shown in FIG. 7. That is, the airflow f that has passed along the side face 513 of the erecting part 51 is guided to an extending direction by the inclined part 52. This forms the airflow f that flows from the spark discharge gap G toward the oblique tip side along the extending direction of the inclined part 52. Hence, the discharge spark generated at the spark discharge gap G is easily stretched toward the oblique tip side by the airflow f. As a result, the flame ignited by the discharge spark can be prevented from being cooled by the ground electrode 5 of the spark plug 1, the wall surface of the combustion chamber, or the like. That is, inhibition of ignition can be suppressed from occurring. Consequently, the flame easily grows in the combustion chamber, and ignitability can be improved.

Then, since the inclination angle θ of the inclined part 52 is set to 30° to 60°, the above-described airflow toward the oblique tip side is easily generated appropriately, and the flame can be grown effectively. This point is also backed up by Experiment Example 2 described below.

As described above, by the synergistic effect of the appropriate shape of the erecting part 51 and the appropriate inclination angle θ of the inclined part 52, the airflow at the spark discharge gap G when the erecting part 51 is mounted to the internal combustion engine with a posture that the erecting part 51 is on the upstream side of the airflow can be ensured. That is, regardless of the mounting posture of the spark plug 1 to the internal combustion engine, the discharge spark can be sufficiently stretched, and ignitability can be sufficiently ensured.

Further, in the spark plug 1, the ground electrode 5 does not need to have a particularly complicated shape. In addition, the ground electrode 5 does not need to be made particularly thin, and thus a special structure to ensure its strength is also not required. Hence, the spark plug 1 excellent in ignitability with a simple structure can be obtained.

As described above, according to the present embodiment, it is possible to provide a spark plug for an internal combustion engine with a simple configuration capable of ensuring stable ignitability regardless of a mounting posture to an internal combustion engine.

Experiment Example 1

In the present example, as shown in Table 1, a relation between a dimensional ratio w/t in the erecting part 51 of the ground electrode 5 and ignitability was evaluated.

That is, with the spark plug 1 shown in Embodiment 1 as a basic structure, samples in which the dimensions w and t of the erecting part 51 were variously changed were prepared and ignitability of each sample was evaluated.

Specifically, as shown in Table 1, the samples were produced in which while w was changed between 1.0 mm and 2.3 mm, w/t was variously changed. Then, a sample of w/t=1.5 as a reference w/t in each width w was prepared as a reference sample. The shape having the dimensional ratio of w/t=1.5 is a shape in which the width w of the erecting part 51 is sufficiently large with respect to the thickness t, and is the same shape as that of an erecting part in the conventional spark plug.

In comparison with an ignitability of the reference sample, ignitability of each sample was evaluated. That is, in comparison with ignitability of the reference sample with the same width w of the erecting part 51, each sample was evaluated.

Ignitability was evaluated with a lean limit A/F as an index. That is, in the internal combustion engine mounting each sample, an air-fuel ratio (A/F) of the air-fuel mixture was gradually changed and an air-fuel ratio as the ignitable limit (that is, lean limit A/F) was measured.

Note that, the conditions of the internal combustion engine in this test were a displacement of 1800 cc, an engine speed of 2000 rpm, and an indicated mean effective pressure of 0.28 MPa. An air-fuel ratio at which a combustion fluctuation ratio (that is, a fluctuation ratio of the indicated mean effective pressure) is 3% was set to the lean limit A/F. The lean limit A/F was defined as an average value of values obtained by performing the test five times for each sample.

Further, the other conditions are as follows and are common in each sample.

The inclination angle θ of the ground electrode 5 was set to 45°. The dimension of the spark discharge gap G was set to 1.05 mm. The precious metal chip constituting the projection part 53 of the ground electrode 5 was formed into a circular cylindrical shape with a diameter of 0.7 mm and a length of 1.0 mm. The precious metal chip constituting the tip part 41 of the center electrode 4 was formed into a circular cylindrical shape with a diameter of 0.6 mm and a length of 0.8 mm. The thread diameter of the mounting screw part of the housing 2 was set to M12. The projection dimension of the center electrode 4 in the plug axial direction Z from the housing tip face was set to 4.0 mm.

Furthermore, the posture of the spark plug mounted to the internal combustion engine was set to a posture in which the erecting part 51 of the ground electrode 5 was positioned on the upstream side of the airflow with respect to the center electrode 4.

The evaluation result is shown in Table 1. In Table 1, D indicates that the lean limit A/F is equivalent to that of the reference sample having the same width w (that is, the difference from the lean limit A/F of the reference sample is less than 0.05). C indicates that the lean limit A/F is improved by 0.05 or more and less than 0.1 with respect to the reference sample having the same width w. B indicates that the lean limit A/F is improved by 0.1 or more and less than 0.4 with respect to the reference sample having the same width w. A indicates that the lean limit A/F is improved by 0.4 or more with respect to the reference sample having the same width w. In addition, E indicates that the spark discharge was generated at the portion other than the spark discharge gap G, that is, a so-called lateral spark was generated, and the lean limit A/F was unmeasurable. Blanks in Table 1 indicate that the corresponding test was not performed. The same applies also to following Table 2 and Table 3.

TABLE 1

| | | w/t | | | | | | | |
|---|---|---|---|---|---|---|---|---|---|
| | | 0.5 | 0.6 | 0.7 | 0.8 | 0.9 | 1.0 | 1.1 | 1.2 |
| w | 2.3 | | | | | | E | D | D |
| [mm] | 2.2 | | | | | E | D | D | D |
| | 2.1 | | | | | E | D | D | D |
| | 2.0 | | | | E | D | D | D | D |
| | 1.9 | | | | E | B | C | D | D |
| | 1.8 | | | E | A | B | C | D | D |
| | 1.7 | | | E | A | B | C | D | D |
| | 1.6 | | E | A | A | B | C | D | D |
| | 1.5 | | E | A | A | B | C | D | D |
| | 1.4 | | E | A | A | B | C | D | D |
| | 1.3 | E | A | A | A | B | C | D | D |
| | 1.2 | E | A | A | A | B | C | D | D |
| | 1.1 | A | A | A | A | B | C | D | D |
| | 1.0 | A | A | A | A | B | C | D | D |

Table 1 shows that the samples that satisfy w/t≤1, w≤1.9 mm, and t≤2.3 mm were evaluated as A, B, or C, and exhibited improvement in ignitability. Further, it shows that any of the samples that satisfy w/t≤0.9, w≤1.9 mm, and t≤2.3 mm was evaluated as A or B, and particularly exhibited significant improvement in ignitability.

Next, the inclination angles θ were set to 30° and 60°, and the same test was performed. The results are shown in Table 2 and Table 3, respectively. Table 2 shows the test result when θ=30°. Table 3 shows the test result when θ=60°.

TABLE 2

| | | w/t | | | | | | | |
|---|---|---|---|---|---|---|---|---|---|
| | | 0.5 | 0.6 | 0.7 | 0.8 | 0.9 | 1.0 | 1.1 | 1.2 |
| w | 2.3 | | | | | | | D | D |
| [mm] | 2.2 | | | | | | D | D | D |
| | 2.1 | | | | | | D | D | D |
| | 2.0 | | | | | D | D | D | D |
| | 1.9 | | | | | B | C | D | D |
| | 1.8 | | | | B | B | C | D | D |
| | 1.7 | | | | B | B | C | D | D |
| | 1.6 | | | B | B | B | C | D | D |
| | 1.5 | | | B | B | B | C | D | D |
| | 1.4 | | | B | B | B | C | D | D |
| | 1.3 | | A | B | B | B | C | D | D |
| | 1.2 | | A | B | B | B | C | D | D |
| | 1.1 | A | A | B | B | B | C | D | D |
| | 1.0 | A | A | B | B | B | C | D | D |

TABLE 3

| | | w/t | | | | | | | |
|---|---|---|---|---|---|---|---|---|---|
| | | 0.5 | 0.6 | 0.7 | 0.8 | 0.9 | 1.0 | 1.1 | 1.2 |
| w | 2.3 | | | | | | | D | D |
| [mm] | 2.2 | | | | | | D | D | D |
| | 2.1 | | | | | | D | D | D |
| | 2.0 | | | | | D | D | D | D |
| | 1.9 | | | | | B | C | D | D |
| | 1.8 | | | | B | B | C | D | D |
| | 1.7 | | | | B | B | C | D | D |
| | 1.6 | | | A | B | B | C | D | D |
| | 1.5 | | | A | B | B | C | D | D |
| | 1.4 | | | A | B | B | C | D | D |
| | 1.3 | | A | A | B | B | C | D | D |
| | 1.2 | | A | A | B | B | C | D | D |
| | 1.1 | A | A | A | B | B | C | D | D |
| | 1.0 | A | A | A | B | B | C | D | D |

Table 2 and Table 3 show that also in cases of θ=30° and θ=60°, the measurement results having similar tendencies as in the case of θ=45° were obtained. That is, the samples that satisfy w/t≤1, w≤1.9 mm, and t≤2.3 mm were evaluated as A, B, or C, and exhibited improvement in ignitability. Further, any of the samples that satisfy w/t≤0.9, w≤1.9 mm, and t≤2.3 mm was evaluated as A or B, and particularly exhibited significant improvement in ignitability.

As described above, the result of the present experiment example shows that when the width w in a plug circumference direction and the dimension t in a plug radial direction in the erecting part 51 satisfy w/t≤1, w≤1.9 mm and t≤2.3 mm, ignitability can be improved. In addition, it shows that if w/t≤0.9 is further satisfied, ignitability can be further improved.

Experiment Example 2

In the present example, as shown in Table 4, a relation between the inclination angle θ of the inclined part 52 of the ground electrode 5 and ignitability was evaluated.

That is, with the spark plug 1 shown in Embodiment 1 as a basic structure, samples in which the inclination angle θ was variously changed were prepared, and ignitability of each sample was evaluated.

Specifically, as shown in Table 4, samples which include erecting parts with four types of cross-sectional shape each having different w and w/t and in which θ was changed between 10° and 90° were prepared. In addition, a sample of θ=90°, which is a reference inclination angle θ in each width w and ratio w/t, was prepared as a reference sample. That is, the reference sample has a shape in which a portion corresponding to the inclined part 52 extends in a direction perpendicular to the plug axial direction Z. In other words, the reference sample has a shape in which a portion corresponding to the inclined part 52 extends in the alignment direction X.

In comparison with ignitability of the reference sample, ignitability of each sample was evaluated. That is, each sample was evaluated in comparison with ignitability of the reference sample having the same width w and ratio w/t.

Ignitability was evaluated with the same method and criteria as in Experiment Example 1.

The evaluation result is shown in Table 4. In Table 4, A, B, C, and D are the same evaluation criteria as in Experiment Example 1, respectively. That is, D indicates that the lean limit A/F is equivalent to that of the reference sample having the same width w and ratio w/t (that is, the difference from the lean limit A/F of the reference sample is less than 0.05). C indicates that the lean limit A/F is improved by 0.05 or more and less than 0.1 with respect to the reference sample having the same width w and ratio w/t. B indicates that the lean limit A/F is improved by 0.1 or more and less than 0.4 with respect to the reference sample having the same width w and ratio w/t. A indicates that the lean limit A/F is improved by 0.4 or more with respect to the reference sample having the same width w and ratio w/t.

TABLE 4

| Inclination angle θ(°) | W = 1.9 mm W/t = 1.0 | W = 1.7 mm W/t = 0.9 | W = 1.5 mm W/t = 0.8 | W = 1.2 mm W/t = 0.7 |
|---|---|---|---|---|
| 90 | D | D | D | D |
| 75 | D | D | D | D |
| 70 | D | D | D | D |
| 60 | C | B | B | A |
| 45 | B | B | A | A |
| 30 | C | B | B | A |
| 20 | D | D | D | D |
| 10 | D | D | D | D |

Table 4 shows that in the spark plugs having any width w and ratio w/t, if the inclination angle θ is in a range of 30° to 60°, ignitability is improved from the reference sample.

As described above, the result of the present example shows that when the inclination angle θ of the inclined part 52 satisfies 30°≤θ≤60°, ignitability can be improved.

Experiment Example 3

Figure 8:
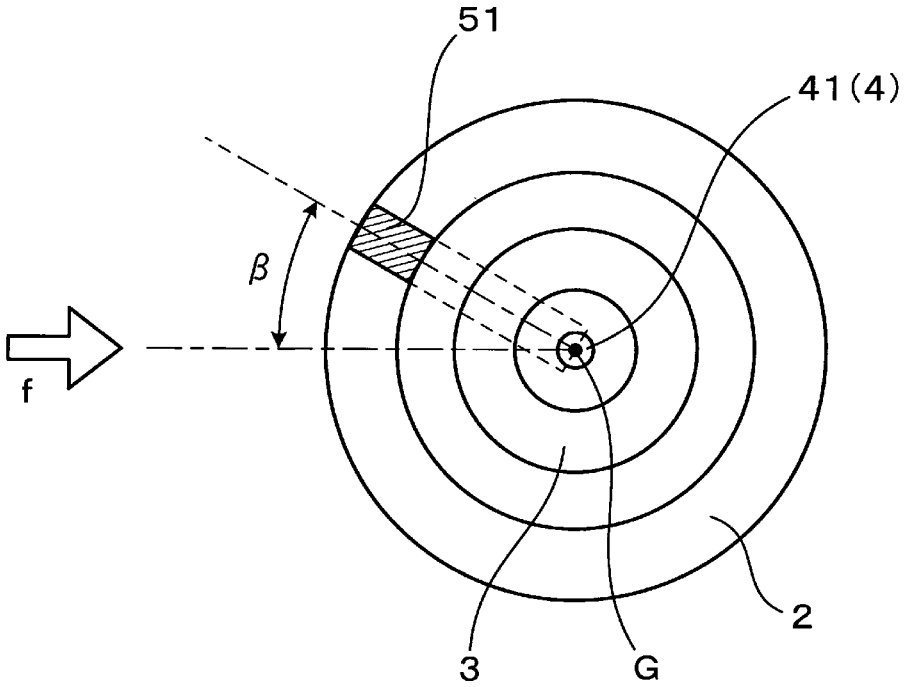
FIG. 8 is an explanatory diagram of a mounting angle β in Experiment Example 3.
Figure 9:
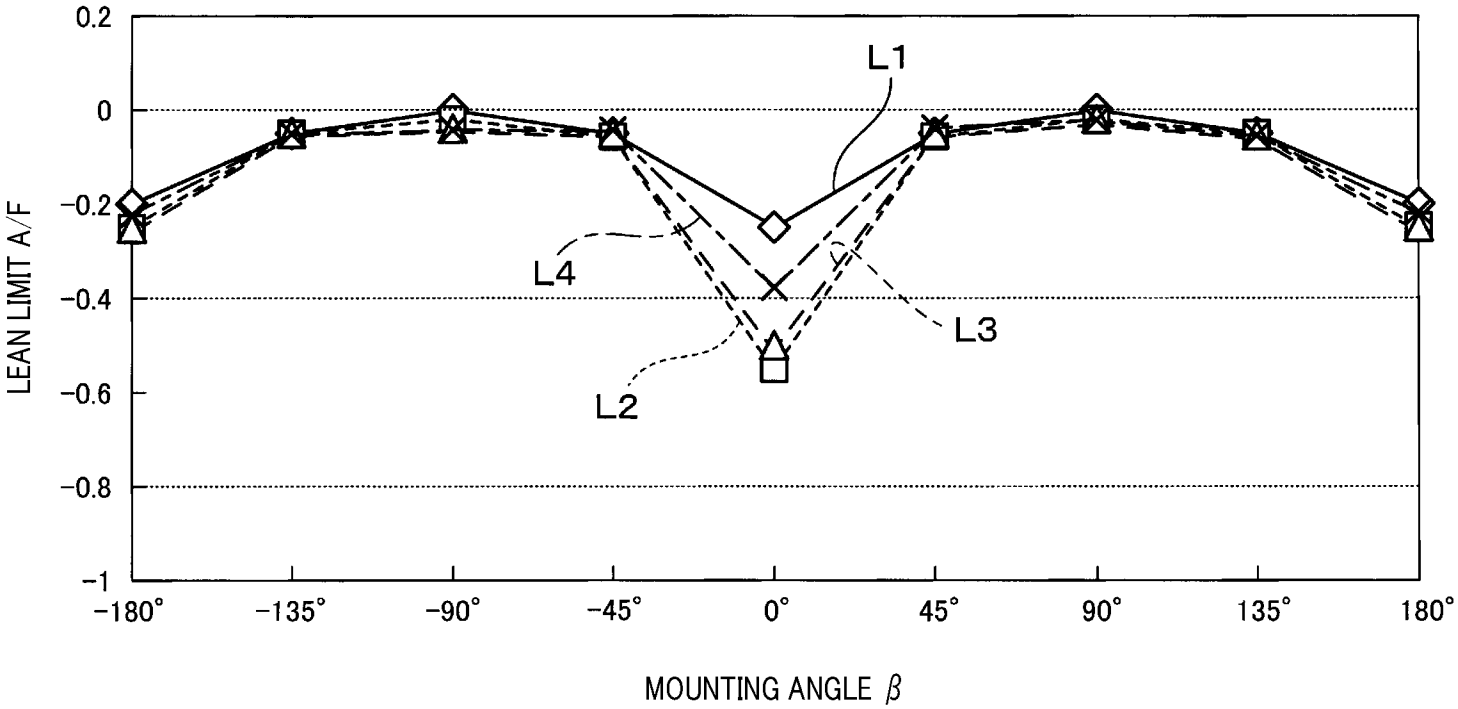
FIG. 9 is a diagram showing a test result in Experiment Example 3.

In the present experiment example, as shown in FIGS. 8 and 9, for the spark plug 1 shown in Embodiment 1, it was examined how the lean limit A/F changes depending on the mounting posture to the internal combustion engine.

As a sample 1, the spak plug 1 shown in Embodiment 1 was prepared, in which the inclination angle θ of the inclined part 52 was set to 45°, and the width w and thickness t of the erecting part 51 were set to 1.7 mm and 1.9 mm, respectively.

As comparative samples, the following Sample 2, Sample 3, and Sample 4 were prepared. In Sample 2, the inclination angle θ was set to 90°, and the width w and thickness t of the erecting part 51 were set to 2.6 mm and 1.3 mm, respectively. In Sample 3, the inclination angle θ was set to 45°, and the width w and thickness t of the erecting part 51 were set to 2.6 mm and 1.3 mm, respectively. In Sample 4, the inclination angle θ was set to 90°, and the width w and thickness t of the erecting part 51 were set to 1.7 mm and 1.9 mm, respectively.

Note that, in each sample, the shape of a cross section orthogonal to the longitudinal direction of the ground electrode 5 is substantially constant from the erecting part 51 to the inclined part 52.

In the test, each spark plug is mounted to an engine of 1800 cc and 4 cylinders. At this time, as shown in FIG. 8, when the spark plug is seen from the axial tip side, the angle (hereinafter referred to as a mounting angle β) formed by an upstream direction of the airflow f and an arrangement position of the erecting part 51 of the ground electrode 5 with respect to the spark discharge gap G was changed from −180° to 180° at intervals of 45°, and the lean limit A/F was measured in the respective states. That is, when the mounting angle β was 0°, the erecting part 51 of the ground electrode 5 was arranged on the upstream side of the spark discharge gap G, and when the mounting angle β was 180° (−180°), the erecting part 51 was arranged on the downstream side of the spark discharge gap G.

For each sample, the lean limit A/F was measured with a direction of the sample to the airflow f changed as described above and the flow speed of the airflow f was set to 20 m/s.

That is, in each state where the spark plug was arranged in a predetermined direction, an engine is operated at the engine speed of 2000 rpm. Then, under the condition that the indicated mean effective pressure Pmi was 0.28 MPa, a combustion fluctuation ratio (fluctuation ratio of indicated mean effective pressure Pmi) was measured from the output of a combustion pressure sensor with the value of A/F (air-fuel ratio) gradually changed, and the lean limit A/F was examined. The lean limit A/F is the same as in Experiment Example 1.

The measurement result of lean limit A/F is shown in FIG. 9. In FIG. 9, a polygonal line indicated by a solid line attached with a code L1 is a measurement result about the spark plug of Sample 1, and a polygonal line indicated by a broken line attached with a code L2 is a measurement result about the spark plug of Sample 2. In addition, a polygonal line indicated by a broken line attached with a code L3 is a measurement result about the spark plug of Sample 3, and a polygonal line indicated by a chain line attached with a code L4 is a measurement result about the spark plug of Sample 4. In a graph of FIG. 9, the horizontal axis is the mounting angle β. The vertical axis is a reduction amount of the lean limit A/F with respect to a reference value. The reference value of the lean limit A/F is a lean limit A/F when the mounting angle β was 90° in Sample 2. The reduction amount is a difference between the reference value and the lean limit A/F. As the minus value is larger, the lean limit A/F is reduced more, and ignitability is degraded.

As shown in FIG. 9, in line graphs L2, L3, and L4 respectively showing lean limit A/Fs in the spark plugs of Sample 2, Sample 3, and Sample 4, the lean limit A/F largely fluctuates depending on the mounting angle β. This means that the lean limit A/Fs of the spark plugs of Sample 2, Sample 3, and Sample 4 largely fluctuate depending on the direction of the airflow f to the spark plug. In other words, the measurement results of Sample 2, Sample 3, and Sample 4 mean that ignitability largely fluctuates depending on the mounting posture of the spark plug to the internal combustion engine.

Particularly, it is shown that at a position where the mounting angle β is 0°, the lean limit A/F is extremely low. That is, it is shown that when the erecting part 51 of the ground electrode 5 was arranged on the upstream side of the airflow f with respect to the spark discharge gap G, the lean limit A/F extremely decreases, and the ignition performance may degrade significantly.

In contrast to this, the line graph L1 showing the lean limit A/F in the spark plug of Sample 1 shows that even at the mounting angle β of 0°, the lean limit A/F is improved. This means that ignitability of the spark plug is sufficiently ensured regardless of the mounting posture. Hence, it is shown that ignitability of the spark plug of Sample 1 is ensured regardless of the mounting posture.

Note that, the measurement result of Sample 3 was almost the same as that of Sample 2. This shows that like Sample 3, it is difficult to improve ignitability at the time of mounting angle β=0° just by inclining the inclined part 52.

In addition, the measurement result of Sample 4 shows that the lean limit A/F at β=0° is slightly higher compared with the measurement results of Sample 2 and Sample 3. Hence, it can be said that improvement of ignitability when the mounting angle β=0° may be expected slightly by setting the dimensional ratio w/t of the erecting part 51 to 1 or less. However, the lean limit A/F still significantly decreases at β=0°. In contrast to this, in the case of Sample 1, the lean limit A/F at the mounting angle β=0° is significantly suppressed from decreasing.

To summarize the above discussion, it can be said that the test results of the present example for Samples 1 to 4 shows the following. That is, while the dimensional ratio w/t of the erecting part 51 is set to 1 or less, and the inclination angle θ of the inclined part 52 is provided, ignitability when the mounting angle β=0° can be improved.

Although the present disclosure is described based on the embodiments, it should be understood that the present disclosure is not limited to the embodiments or structure. The present disclosure also includes various variations and modifications within an equivalent range. In addition, various combinations and forms and other combinations and forms which further include one element alone, more than that, or less than that in addition to the various combinations and forms are also included in the category and thought range of the present disclosure. For example, in Embodiment 1, the projection part 53 is provided in the ground electrode 5; however, a configuration in which the projection part is not provided in the ground electrode may be used.

What is claimed is:

1. A spark plug for an internal combustion engine, comprising:

a housing that is cylindrical;

an insulator that is cylindrical and held inside the housing;

a center electrode held inside the insulator such that a tip of the center electrode projects from the insulator; and a ground electrode that is connected to the housing and forms a spark discharge gap between the center electrode and the ground electrode, wherein the ground electrode includes an erecting part that extends from the housing and an inclined part that is bent from the erecting part toward the center electrode extend obliquely, an end edge of the ground electrode on an opposite side from the housing is a tip of the inclined part, the erecting part satisfies w/t≤1, w≤1.9 mm, and t≤2.3 mm, where t is a dimension in an alignment direction of the erecting part and the center electrode, and w is a dimension orthogonal to each of the alignment direction and a plug axial direction, and an inclination angle θ of the inclined part with respect to the plug axial direction satisfies 30°≤θ≤60°.

2. The spark plug for an internal combustion engine according to claim 1, wherein the erecting part further satisfies w/t≤0.9.

3. The spark plug for an internal combustion engine according to claim 1, wherein the ground electrode has a projection that projects from a face of the inclined part that faces the center electrode, and the spark discharge gap is formed between the projection and the tip of the center electrode.

4. The spark plug for an internal combustion engine according to claim 2, wherein the ground electrode has a projection that projects from a face of the inclined part that faces the center electrode, and the spark discharge gap is formed between the projection and the tip of the center electrode.

5. The spark plug for an internal combustion engine according to claim 1, wherein the erecting part further satisfies 0.7≤w/t≤0.9, and 1.2 mm≤w≤1.7 mm.

6. The spark plug for an internal combustion engine according to claim 2, wherein the erecting part further satisfies 0.7≤w/t≤0.9, and 1.2 mm≤w≤1.7 mm.

7. The spark plug for an internal combustion engine according to claim 3, wherein the erecting part further satisfies 0.7≤w/t≤0.9, and 1.2 mm≤w≤1.7 mm.

8. The spark plug for an internal combustion engine according to claim 4, wherein the erecting part further satisfies 0.7≤w/t≤0.9, and 1.2 mm≤w≤1.7 mm.

* * * * *